US007866511B2

(12) United States Patent
Harrison et al.

(10) Patent No.: US 7,866,511 B2
(45) Date of Patent: Jan. 11, 2011

(54) DISPENSING SYSTEM

(75) Inventors: Roy Harrison, Woolford, MD (US); Ernest E. Dill, Jr., Viola, DE (US)

(73) Assignee: Celeste Industries Corporation, Easton, MD (US)

( * ) Notice: Subject to any disclaimer, the term of this patent is extended or adjusted under 35 U.S.C. 154(b) by 1313 days.

(21) Appl. No.: 10/519,819

(22) PCT Filed: Jul. 3, 2003

(86) PCT No.: PCT/US03/21033

§ 371 (c)(1),
(2), (4) Date: Feb. 1, 2006

(87) PCT Pub. No.: WO2004/004529

PCT Pub. Date: Jan. 15, 2004

(65) Prior Publication Data

US 2006/0144861 A1 Jul. 6, 2006

Related U.S. Application Data

(60) Provisional application No. 60/394,041, filed on Jul. 3, 2002.

(51) Int. Cl.
*B67D 7/84* (2010.01)
*B65D 19/00* (2006.01)

(52) U.S. Cl. ..... 222/173; 222/464.7; 222/180; 248/346.03; 248/310

(58) Field of Classification Search ..... 222/173, 222/180, 184, 377, 464.7; 248/346.04, 310, 248/154, 346.07, 551, 346.06, 346.03
See application file for complete search history.

(56) References Cited

U.S. PATENT DOCUMENTS

| | | | | | |
|---|---|---|---|---|---|
| 231,597 | A | * | 8/1880 | Matthews | 222/173 |
| 3,124,264 | A | * | 3/1964 | Waisberg | 215/205 |
| 3,155,281 | A | * | 11/1964 | Stracey | 222/107 |
| 4,144,983 | A | | 3/1979 | Pauls et al. | |
| 4,676,370 | A | | 6/1987 | Rudick | |
| 5,062,549 | A | * | 11/1991 | Smith et al. | 222/377 |
| 5,148,948 | A | | 9/1992 | Granville et al. | |
| 5,240,147 | A | | 8/1993 | Frazier et al. | |
| D344,232 | S | | 2/1994 | Granville | |
| 5,350,087 | A | | 9/1994 | Frazier et al. | |
| D351,794 | S | | 10/1994 | Foster | |
| 5,480,068 | A | | 1/1996 | Frazier et al. | |

(Continued)

FOREIGN PATENT DOCUMENTS

EP 0 612 667 A 8/1994

(Continued)

*Primary Examiner*—Kevin P Shaver
*Assistant Examiner*—Stephanie E Williams
(74) *Attorney, Agent, or Firm*—Kilpatrick Stockton LLP

(57) ABSTRACT

Various embodiments of the present invention relate to a dispensing system for use in lavatories. The system may include a container, a mount, and optionally, a conversion module. The container may have an attached dispensing mechanism and a projection that is adapted to fit into a receiver on the mount or conversion module. The receiver may be adapted to engage the projection on the container. The assembled system secures the container into the mount and allows the container to be rotated to a proper orientation while it is secured to the mount.

11 Claims, 10 Drawing Sheets

U.S. PATENT DOCUMENTS

| | | | |
|---|---|---|---|
| 5,836,466 | A | 11/1998 | Briere et al. |
| 6,016,930 | A | 1/2000 | Mathes et al. |
| 6,223,919 | B1 | 5/2001 | Kuehn |
| D467,163 | S | 12/2002 | Crawford |
| 6,520,470 | B1 | 2/2003 | Chan |
| D485,747 | S | 1/2004 | Crawford |
| D486,062 | S | 2/2004 | Huang |
| D500,247 | S | 12/2004 | Harrison |

FOREIGN PATENT DOCUMENTS

| | | | |
|---|---|---|---|
| EP | 0 997 384 | A1 | 5/2001 |
| EP | 1 103 212 | A | 5/2001 |
| EP | 312 294 | A1 | 5/2003 |

* cited by examiner

DISPENSING SYSTEM

This application claims priority to and, by this reference, incorporates herein in its entirety provisional application No. 60/394,041 filed Jul. 3, 2002, and entitled Dispensing System.

RELATED FIELDS

Various aspects and embodiments of this invention may relate to a dispensing system and more particularly to new dispensing containers, new mounts for those containers, and new conversion modules for converting existing mounts to interface with dispensing containers.

BACKGROUND

Liquid soap dispensers typically include a container with a removable discharge apparatus, usually in the nature of a manually-actuated reciprocating pump attached to the container for dispensing measured amounts of liquid soap from the container. Many of these soap dispensers are provided in public lavatories of business establishments or on vehicles such as tour buses, airplanes, or recreational vehicles. It is often necessary to provide a means of securing a liquid soap dispenser in these lavatories to prevent theft, to ensure stability of the dispenser in use, or to prevent the movement of the soap dispensers while a vehicle moves.

A number of countertop mounted soap dispensers have been developed to prevent theft of soap dispensers and/or to provide stability. These dispensers usually include refillable soap containers into which dip tubes are inserted. Dip tubes typically include one or two check valves with a piston-type pump. These pump and valve arrangements for countertop mounted soap dispensers have generally been intended as permanent installations. Over a period of time the valves and/or pumps may fail or become clogged so that no soap can be dispensed. Further, to refill the soap containers, it may be necessary to disengage the container from the countertop mounting bracket and pour liquid soap into the open topped receptacle. These countertop-mounted soap dispensers have not been very effective at preventing theft of soap dispensers because the dispensers can be easily disengaged from the mount.

Disposable soap bottles have also been used in public restrooms. These bottles usually include a dip tube and a positive displacement pump. These disposable soap bottles are intended to merely sit on the countertop of a wash basin. These bottles may be stolen and certainly will create waste in public restrooms. Additionally, these bottles are not stable during use; these bottles will also shift while a vehicle moves.

Some soap bottles have been designed to minimize the possibility of theft by making the bottles unattractive to persons who use such soap bottles in public places. For instance, the owner of this application also owns U.S. Pat. No. 5,148,948, which is hereby incorporated in its entirety by this reference. U.S. Pat. No. 5,148,948 describes a bottle having a bottom shaped to preclude the effective use of the bottle without the appropriate mount. Because users' personal residences and businesses will not have such a mount, users typically will not steal the bottle because it would be less useful to them at their home or business.

When placing previous dispensing bottles within a mount, one must ensure that the pump dispenser is oriented in the proper direction after the bottle has been secured into the mount. For instance, the threads coupling the mount and bottle must allow tight fixation of the bottle, and allow for correct orientation of the pump head. Some bottles have pump heads that can be rotated to the proper orientation. Other bottles, however, may be outfitted with pump heads that do not rotate easily. For instance, larger nozzles have been developed to facilitate dispensation of foam soap. These larger pump heads typically may not be rotated to allow proper orientation of the pump's dispenser. This is a problem, especially in the tight confines of an airline, bus or train lavatory where it is important that the bottle is both fully securable and easily rotatable.

One could overcome such a problem by adopting new and unique mounting mechanisms for both the mount and the bottle. However, that approach can be expensive and time-consuming because vehicles and lavatories that have already been outfitted with one type of mount would need to be completely reworked. Aside from the capital outlays for new mounts, the time and labor associated with removing the old mounts and inserting new ones (without damaging the facilities) would be substantial.

U.S. Pat. No. 6,520,470 to Chan discloses an alternative bottle and mount system. The bottle has a lower and upper groove, each completely encircling the perimeter of a protrusion at the end of the bottle. The protrusion fits into a recess in a base. A lower set of three pins is equally spaced about the inner circumference of recess in the base. Each of the three pins is spring-loaded so as to project from the inner face of the recess. Inserting the bottle pushes the pins back into a recess. After full insertion the lower set of pins snap back into the lower groove to help hold the bottle in place. A second, upper set of pins may be moved into the upper groove to completely lock the bottle into the base. The second, upper set of three pins are spring-loaded so as normally to be recessed; thus the end of the pin normally is recessed relative to the face of the inner periphery of the recess. After bottle insertion, one twists a ring on the outside of the base; the ring causes cam surfaces to push the three upper pins into the upper groove.

At least Chan's upper set of pins appear to enter the groove far enough to bear against the sidewall of the protrusion and completely lock the bottle in place. This prevents removing the bottle until the ring is unlocked. Unfortunately, the combined friction from the three sets of upper and lower pins would appear also to prevent rotating the bottle to a better orientation so the user can access the pump-head at any time. Further, requiring six sets of springs and pins to be inserted into the mount greatly complicates manufacturing and adds to the number of pieces forming, and thus the pricing of, the mount. Dispensing systems must be robust given the demands they face in use. Complex spring and pin assemblies are far more likely to fail than unitary or more simple mounting systems. These are substantial problems since companies who desire to provide refillable bottles often expect the mounts to have long useful lives, yet be delivered for free or at substantial discounts. Soap and bottle suppliers thus recoup their costs at least partially by providing bottles adapted for use in the mounts.

DEFINITIONS

In this application, container may include any bottle or other vessel that may dispense amounts of a fluid or a semi-fluid, such as, but not limited to: soaps, shampoos, lotions, mouthwashes, aftershaves, creams or pastes. Mount may include any structure capable of attachment to a surface, such as, but not limited to, countertops, walls, floors, shelves, various surfaces in bathrooms or other mounts. Projection may include securing means extending from or into either a container or a mount. Receiver may include securing means formed in either a container or a mount and of a suitable size and shape to accept a corresponding projection. Securing means may include any appropriate structure located on the projection and/or receiver, such as, but not limited to: channels, grooves, pins, ball-detents, locks, flanges, couplers, indentations, flexible arms, resilient arms or any other appropriate securing means for releasably securing the bottle to the mount such that the bottle may rotate relative to the mount without releasing the bottle.

SUMMARY

Various aspects and embodiments of the present invention aim to overcome some or all of the above described problems by providing an improved dispensing container, an improved mount for releasably securing the container, and securing means on the container and the mount, where the mount releasably secures the container such that the container may rotate without the mount releasing the container. In some embodiments, the container may only be inserted into or removed from the mount when one of the securing means on the container is aligned with the securing means on the mount. Additionally, a conversion module may adapt conventional mounts to work with various containers of this invention or other conventional containers.

Containers according to some embodiments of the present invention may contain soap, shampoo, lotion, disinfectant, or any other desirable product. The container may be of any conventional or non-conventional size or shape and may be made of any suitable material, such as plastic, glass, acrylic, paper or the like. A discharge mechanism removably or non-removably attached to the container may dispense measured amounts of product from the container.

In certain embodiments, a portion of the container, preferably a bottom portion, may include securing means to interact with corresponding securing means on the mount. In some embodiments, the container securing means are located proximate a projection extending from the container. The projection may be adapted to correspond to a receiver. Alternatively, the projection may extend from the mount and the receiver may be located in the container. The mount securing means may be located proximate a receiver located within the mount.

The mount may be attached to a countertop, shelf, wall or other fixed structure in a public or private lavatory. Because the mount may be secured to a fixed structure, engaging the projection in the receiver to secure the container to the mount may prevent removing the container from the lavatory. However, although the interaction of the receiver with the projection secures the container to the mount, the container may nevertheless rotate relative to the mount without disengaging from the mount.

To secure the container to the mount, securing means such as a pin, ball-detent, lock, snap lock or any other suitable securing means located on the receiver may interact with a channel, groove and/or other securing means on the projection adapted to interact with the securing means on the receiver. For instance, in a preferred embodiment, a first channel may be inscribed about a portion of the projection's circumference. In that embodiment, a pin or other suitable securing means located on the receiver may slidably interact with the first channel, holding the container in place through mechanical force. A second channel, inscribed perpendicularly to the first channel on the projection and intersecting the first channel, may permit the insertion and/or removal of the container from the mounting base when the second channel is aligned with the pin. During insertion, the pin may slide through the second channel to enter the first channel. The second channel may be inclined such that the pin may slide through the groove to allow insertion of the container, but not slide through the groove in the opposite direction to permit removal of the container. In some embodiments, rotating the container to a certain orientation aligns the pin with a third channel perpendicularly oriented and intersecting the first channel. The third channel may incline in an opposite direction as the second channel, permitting removal of the container from the mount in a similar manner to the second channel, thereby allowing insertion of the container into the mount. In some embodiments, there may be a single untapered channel that permits both insertion and removal of the container from the mount.

In other aspects and embodiments of the present invention, the mount may include at least one snap lock, rather than a pin. The snap lock may mechanically interact with the first channel, releasably securing the container to the mount, while permitting at least partial rotation of the container relative to the mount.

In other aspects of the present invention, a mount usable with a container of certain embodiments of the present invention may be formed by using a conversion module. The conversion module may include an outer portion adapted to fit within conventional mounts, such as the mounts shown in U.S. Pat. Nos. 5,408,068, 5,350,087 or 5,148,948, each of which are hereby incorporated in their entirety by reference. For instance, in one embodiment, threads on an outside surface of the conversion module may couple with and engage internal threads on a conventional mount, such as the mount shown in U.S. Pat. No. 5,148,948. The conversion module may be fixed into the conventional mount either removably or permanently, using threads, glue, epoxy or a mechanical fixation. Thereafter, the inner portion of the conversion module acts as the receiver for the projection in a similar manner as described above. That is, the conversion module may have, at one orientation, a pin or other suitable securing means that interacts with channels formed on a container's projection, rotably securing the container to the conversion module. By providing such a conversion module, the operator of the lavatory can choose to use conventional containers or the containers made according to this invention without investing in entirely new mounts and their installation.

Skilled persons will recognize that other embodiments for this invention exist. For instance, it will readily be appreciated that the pin, ball-detent, snap lock or like securing means could be formed on the container's projection. The mount could then be provided with a channel, or other appropriate securing means, for fixing the container within the mount using mechanical force.

It is an object and advantage of certain aspects and embodiments of the present invention to provide a dispensing container capable of being releasably secured by a mount such that the container can rotate relative to the mount without disengaging from the mount.

It is also an object and advantage of certain aspects and embodiments of the present invention to provide a dispensing system including a container and a mount where the container can only be removed from and inserted into a mount when securing means on the container are aligned with securing means on the mount.

It is also an object and advantage of certain aspects and embodiments of the present invention to provide a dispensing system including a container and a mount, the container capable of being releasably secured by a mount such that the container can rotate relative to the mount without disengaging from the mount.

It is also an object and advantage of certain aspects and embodiments of the present invention to provide a conversion module capable of adapting an existing mount to releasably secure a container such that the container can rotate relative to the mount without disengaging from the mount.

It is also an object and advantage of certain aspects and embodiments of the present invention to provide a dispensing system to be used in public lavatories.

It is another object and advantage of certain aspects and embodiments of the present invention to provide a means of preventing theft of dispensers found in public lavatories.

It is another object and advantage of certain aspects and embodiments of the present invention to provide a means of preventing sliding or shifting of dispensers in vehicles.

It is another object and advantage of certain aspects and embodiments of the present invention to prevent unnecessary waste in public restrooms.

It is another object and advantage of certain aspects and embodiments of the present invention to provide a dispenser that uses a mount intended to be permanently affixed to a fixture in a public restroom.

It is another object and advantage of certain aspects and embodiments of the present invention to provide a container that includes securing means for releasably securing the container to a mount including corresponding securing means.

It is another object and advantage of certain aspects and embodiments of the present invention to provide a container that can be moved to a proper orientation while it remains secured in the mount.

Other objects, features, aspects, and advantages of this invention will be readily understood by those skilled in the art by reference to the remainder of this document.

BRIEF DESCRIPTION OF THE DRAWINGS

FIG. 1 is a side cross-section view of a first embodiment of a dispensing system of the present invention.

FIG. 2 is a sectional side view of a projection on a container of another embodiment of the present invention.

FIG. 3 is a sectional side view of a projection on a container of another embodiment of the present invention.

FIG. 4 is a sectional side view of a projection on a container of another embodiment of the present invention.

FIG. 5 is a side cross-section view of a mount of another embodiment of the present invention.

FIG. 6 is a top view of a mount of another embodiment of the present invention.

FIG. 7 is a side cross-section view of the mount illustrated in FIG. 6.

FIG. 8 is a side cross-section view of a dispensing system according to another embodiment of the present invention.

FIG. 9 is a side cross-section view of a dispensing system according to another embodiment of the present invention.

FIG. 10 is a perspective view of a mount according to another embodiment of the present invention.

FIG. 11 is a sectional cross-section side view of a conversion module according to another embodiment of the present invention.

FIG. 12 is a sectional cross-section side view of a conversion module according to another embodiment of the present invention.

FIG. 13 is a perspective view of a mount according to another embodiment of the present invention.

DETAILED DESCRIPTION

Figure 1:
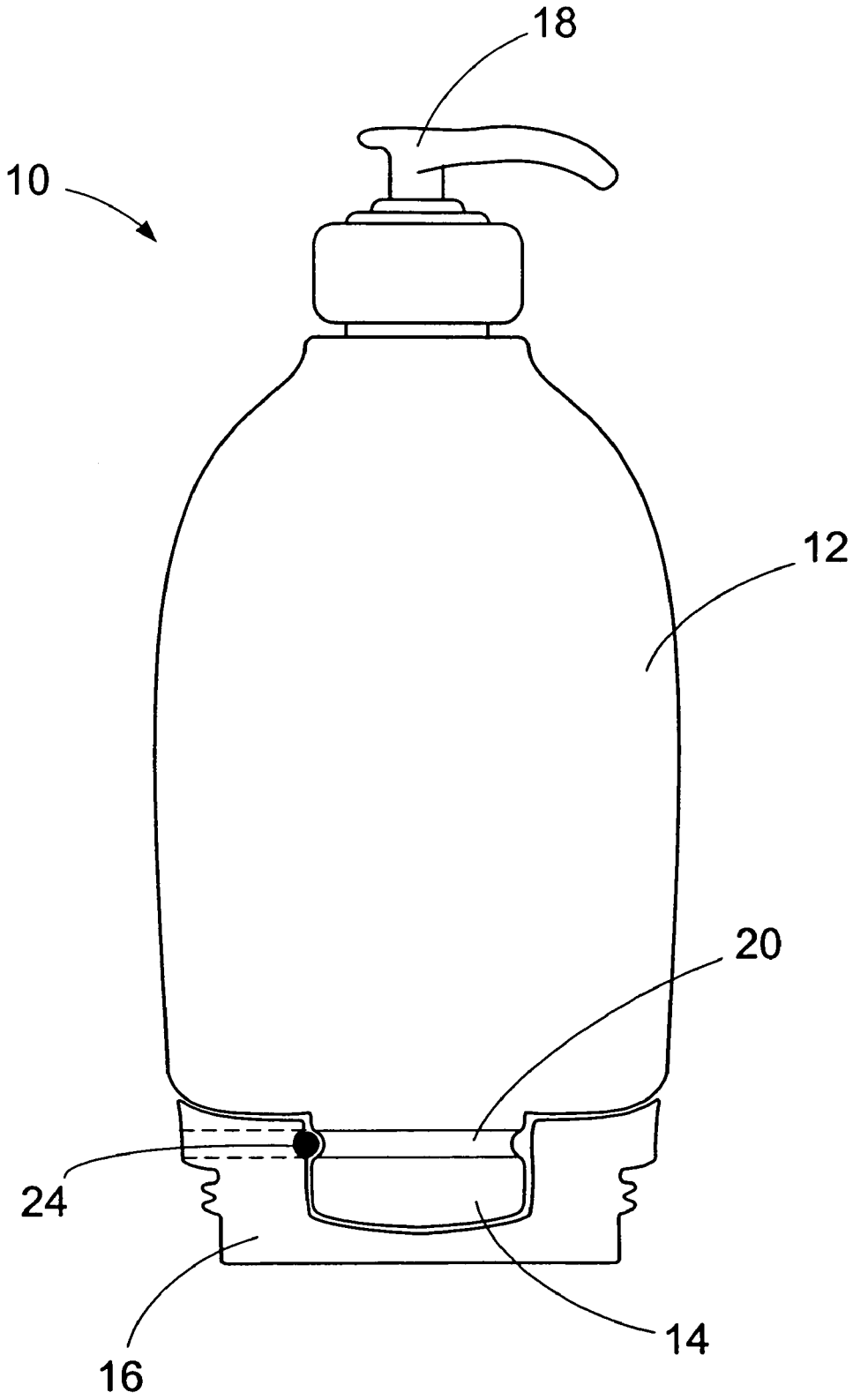
FIGS. 1-13 illustrate only preferred embodiments of the present invention and do not limit the scope of the invention claimed.

FIG. 1 shows a dispensing system 10 of the present invention, which may include a container 12 having a projection 14 that may be releasably secured to a mount 16. The container 12 may be of any suitable size or shape and may be constructed of any suitable material, such as plastic, glass, acrylic or other material. The container 12 may be filled with liquid, foam, cream or any product of any suitable consistency (such as soap, shampoo or lotion). The container may include an opening for removably attaching a dispensing mechanism 18. Alternatively, the dispensing mechanism 18 may be integral to container 12 or permanently attached to container 12. The opening for attaching dispensing mechanism 18 may be of a size suitable for pouring a product into the container 12. The opening may be surrounded by one or more external threads to facilitate attaching a dispensing mechanism 18.

Dispensing mechanism 18 may be a nozzle, a manually actuated pump, or any other suitable dispenser. Dispensing mechanism 18 may dispense measured amounts of any product found in container 12. In a preferred embodiment, the dispensing mechanism 18 is a manually actuated pump inserted into an opening at an upper end of the container 12.

Figure 2:
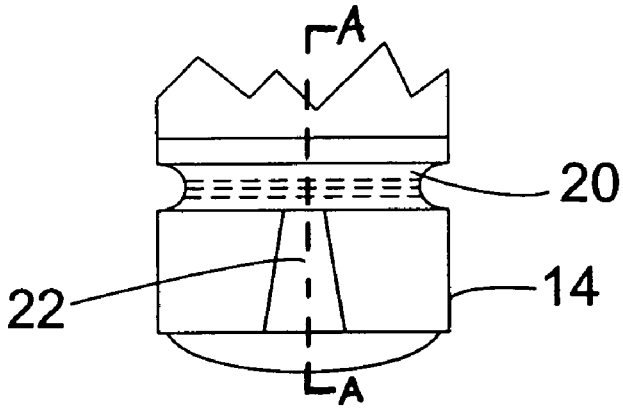

As shown in FIG. 1, the container 12 may include a projection 14 that may be integrally formed from container 12. Alternatively, projection 14 may be formed separately and later attached to container 12. In some embodiments, the projection 14 may be welded, adhesively secured or otherwise coupled to a lower end of the container 12. Preferably, the projection 14 is integrally molded from the lower end of the container 12. Preferably, the projection 14 downwardly extends from a lower end of the container 12. The projection 14 may be of any suitable size or shape to allow insertion into a receiver of mount 16. In the preferred embodiment shown, the projection 14 is a generally cylindrical structure having a diameter smaller than the diameter of the generally cylindrical container 12. As shown in FIG. 2, projection 14 may be formed about a central axis as illustrated by line A. In some embodiments, projection 14 includes a rounded bottom portion to prevent use of container 12 without mount 16.

FIG. 1 shows that the projection 14 may include securing means 20 that may releasably engage securing means 24 extending from surfaces of the receiver of mount 16. The securing means on the projection 20 and the securing means on the receiver 24 together may form a locking mechanism. In the embodiment shown in FIG. 1, the projection 14 securing means is a first channel 20 circumscribing the projection 14. In the embodiment shown in FIG. 1, the receiver securing means is a pin 24, although other appropriate securing means may be used. Pin 24 and first channel 20 may be adapted to complement one another such that pin 24 may slidably interact with channel 20. In the embodiment shown in FIG. 1, pin 24 is a ball-detent. A ball-detent 24 may be obtained from Reed & Company, of San Diego, Calif. Preferably, first channel 20 extends continuously around the perimeter of projection 14. First channel 20 may be shortened, however, depending on the degree of rotation desired. In a most preferred embodiment, the first channel 20 is located around an upper portion of projection, as shown in FIGS. 1-4.

As shown in FIG. 2, to facilitate insertion of a container 12 into a mount 16, projection 14 may include a second channel 22 that extends perpendicularly from first channel 20 to a lower end of projection 14. Second channel 22 may be of a dimension that engages pin 24 in a mount 16. In the embodiment shown in FIG. 2, second channel 22 inclines from one end to the other. The incline of second channel 22 permits pin 24 to slidably interact with second channel 22 such that container 12 may be inserted into the mount 16, but not removed from mount 16, when second channel 22 is aligned with pin 24.

Figure 3:
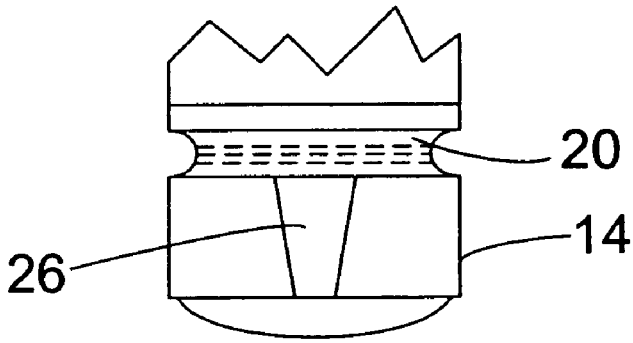

In some embodiments, projection 14 includes a third channel 26, in addition to second channel 22, as shown in FIG. 3. Third channel 26 may have much the same structure as second channel 22, however, third channel 26 preferably inclines in the opposite direction as second channel 22. Third channel 26 inclines such that when pin 24 is aligned with third channel 26, container 12 can be removed from mount 16, but not inserted into mount 16.

Figure 4:
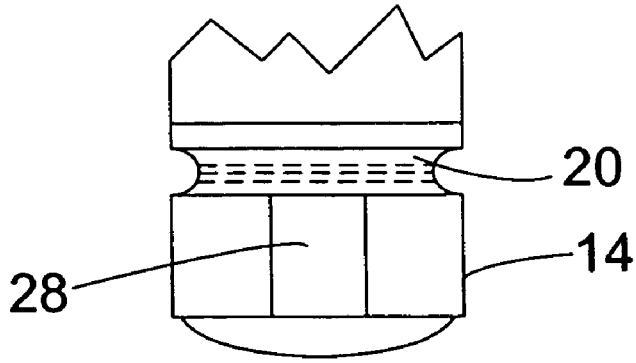
Figure 5:
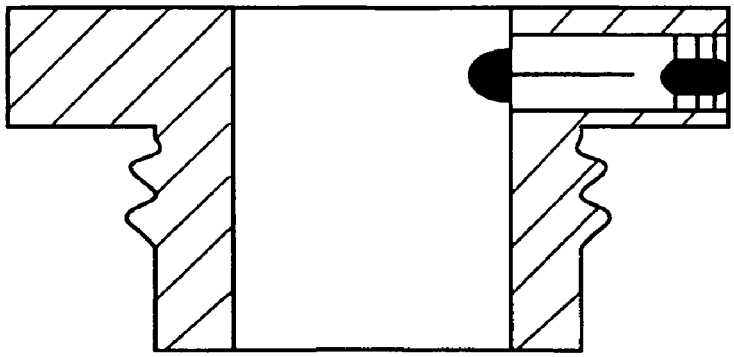

In other embodiments, such as those shown in FIG. 4, projection 14 has an untapered channel 28, which permits container 12 to be inserted and removed from mount 16 when pin 24 is aligned with channel 28.

In some embodiments and aspects of the present invention, mount 16 may include multiple pins 24 for engaging first channel 20. In other various embodiments and aspects of the present invention, projection 14 may include a pin or other suitable securing means for engaging channels formed on an interior portion of a mount 16.

Figure 8:
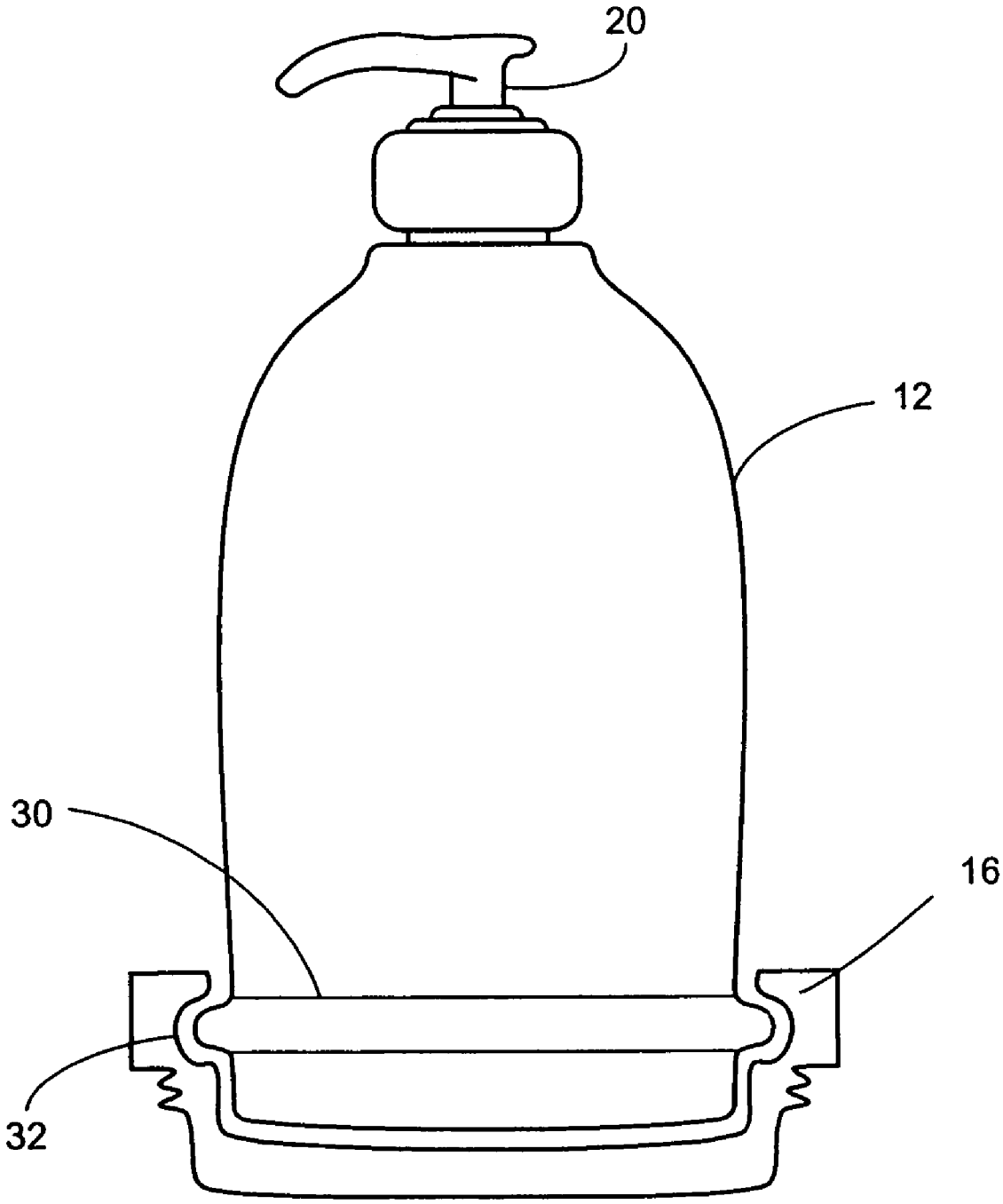

In another embodiment of this invention, as shown in FIG. 8, the container 12 may include a circumferential lip 30. The lip 30 may be continuous or non-continuous. In a preferred embodiment, circumferential lip 30 protrudes about 0.006 of an inch from container 12. Preferably, the lip 30 is constructed of a plastic material that gives to compression as the container 12 is placed into a mount 16 that has a complementary indentation 32 that engages the lip 30. The interaction of lip 30 and indentation 32 secures container 12 to mount 16, while permitting container 12 to at least partially rotate relative to mount 16. The indentation 32 on the mount 16 may be continuous or non-continuous.

Figure 9:
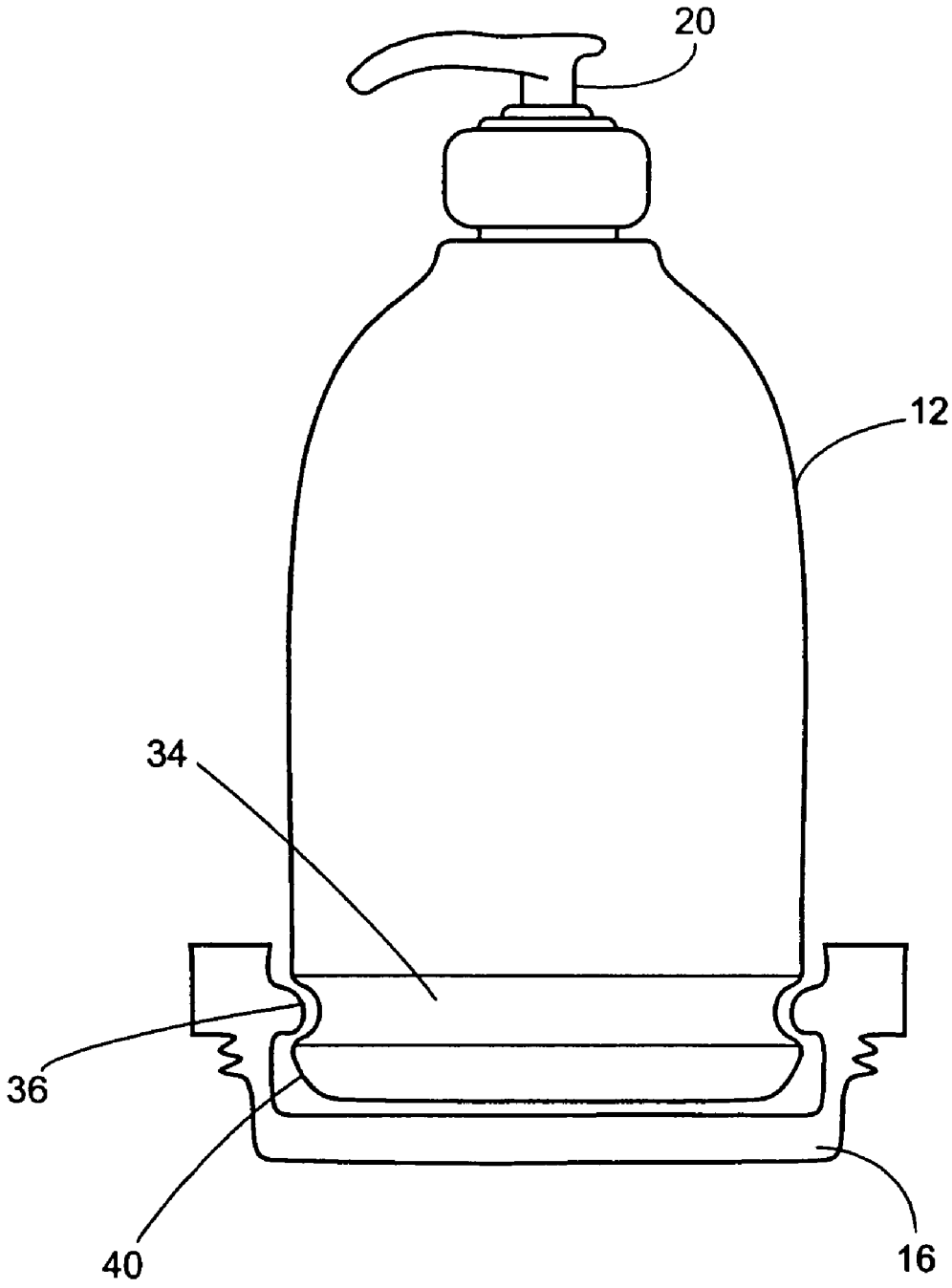
Figure 10:
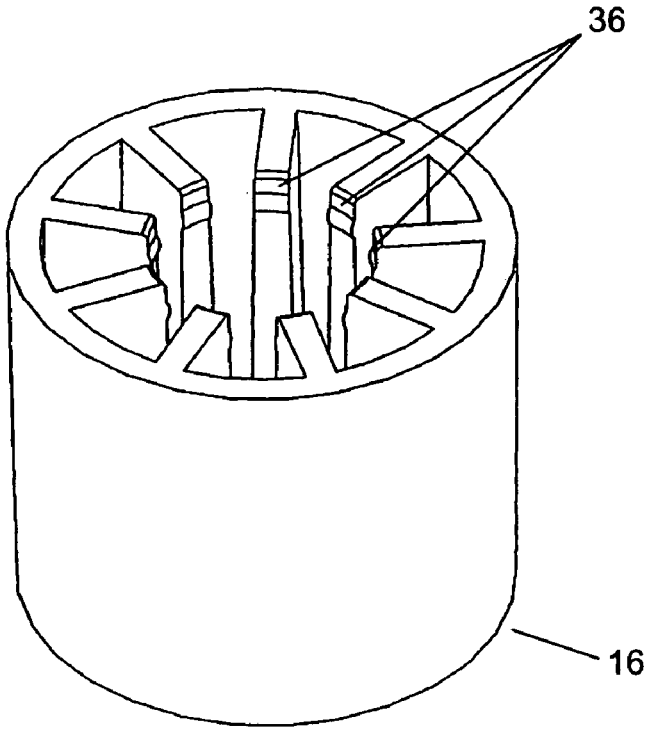

As shown in FIG. 9, in an alternative embodiment, the container 12 may include a continuous or non-continuous circumferential indentation 34, and the mount 16 may include a continuous or non-continuous lip 36. In this embodiment, the lip 36 on the mount 16 engages the indentation 34 on the container 12 to secure the container 12 into the mount 16, while permitting the container 12 to at least partially rotate relative to mount 16. The lip 36 on mount 16 may be continuous or non-continuous as illustrated in FIGS. 9 and 10 respectively. In the embodiment shown in FIG. 9, a bottom portion of container 12 may include a rounded portion 40 to facilitate insertion of container 12 into mount 16.

Figure 11:
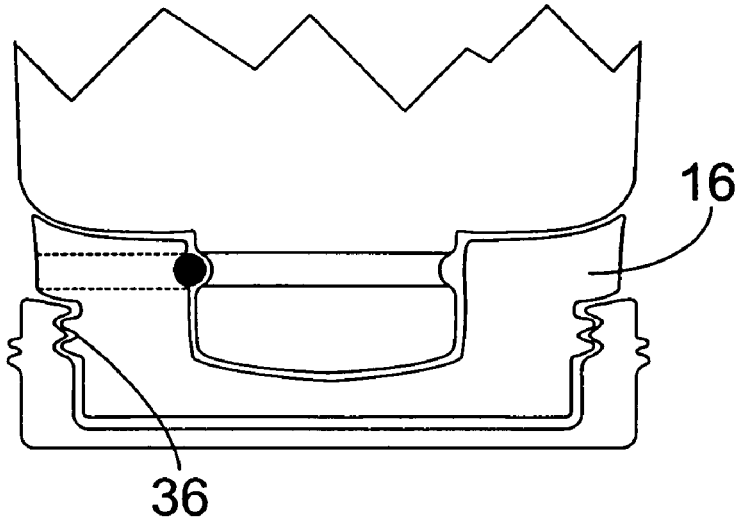

In another embodiment, as illustrated in FIG. 11, the mount may be a base 16 having multiple external threads 36 such that the base can be used as a conversion module 16. The external threads on the conversion module 16 may be sized and shaped such that conversion module 16 may be secured to another mount, that may or may not be already installed in a lavatory. In one embodiment, the conversion module 16 may be permanently secured to another mount using glue, epoxy, or any other suitable adhesive. In still other embodiments, an interior portion of a conversion module may be formed to fit into mounts according to certain aspects of the present invention, yet also include recessed interior portions designed to accept conventional, or non-convention containers. For instance, an interior portion of a conversion module may be formed as a threaded receiver for rotably or non-rotably securing containers including threaded projections descending from bottom, or other, portions of the container.

Figure 12:
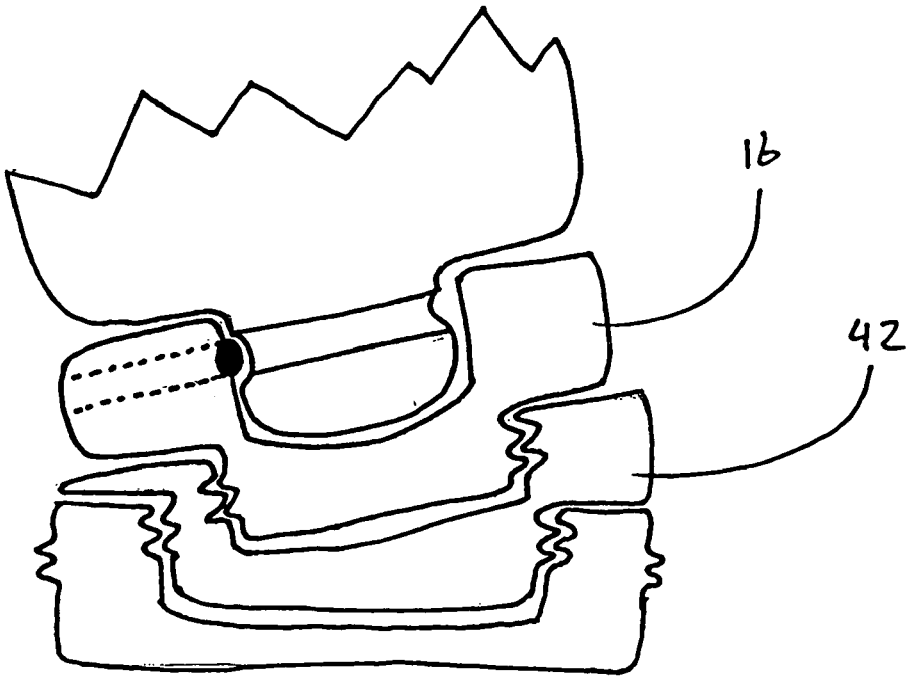

FIG. 12 shows a conversion module 16 mounted in an angled mount 42, such that container 12 can be mounted at angle relative to a surface. In other embodiments, conversion module 16 and angle mount 42 may be formed from a single unit. In still other embodiments, angle mount 42 may be adapted to insert into an existing mount.

In some embodiments of the present invention, the mount 16 may be secured to a fixture in a restroom by an integral, threaded stud depending from the bottom of the mount 16 and extending through a hole provided in the fixture. In some embodiments, the mount 16 may also be comprised of a cup having an upper flange portion. Alternatively, the mount 16 may be in the form of a cup having a pressure-sensitive adhesive layer for attachment to a support surface.

In a preferred method of using some embodiments of the present invention, the container 12 is inserted into the mount 16 and rotated until a spring loaded ball-detent 24 of the mount 16 engages a second channel 22 at the base of the projection 14 of the container 12. After the ball-detent 24 engages the second channel 22, the container 12 is further inserted into the mount 16 as the ball-detent 24 slides vertically along the second channel 22 of the projection 14 until it pops into the first channel 20 of the projection 14, securing the container 12 into the mount 16, as shown in FIG. 1. Once the container 12 is secured to the mount 16, the container 12 may be rotated, with the ball-detent 24 sliding along first channel 20, without being removed from the mount 16. For removal, the container 12 may be rotated to align the third channel 26 and the ball-detent 24 of the mount. By applying a slight upward pressure to the container 12, the ball-detent 24 engages the third channel 26. The ball-detent 24 proceeds vertically along the third channel 26, allowing the container 12 to be removed from the mount 16.

Figure 6:
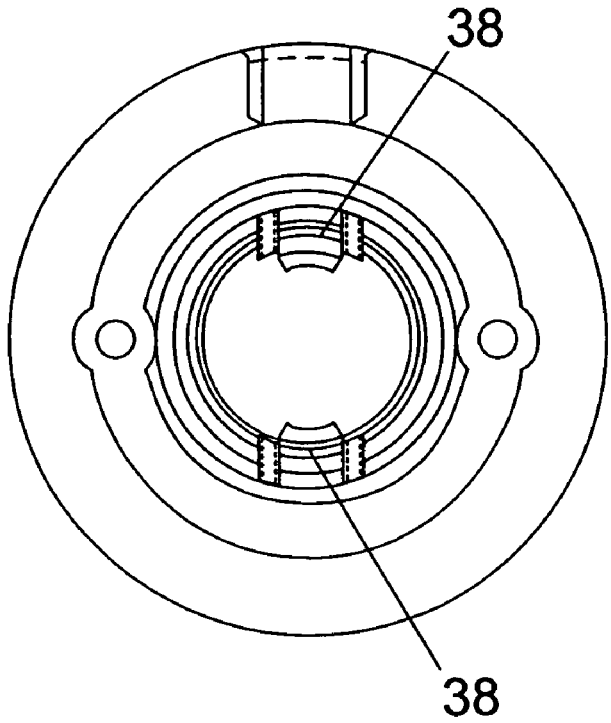
Figure 7:
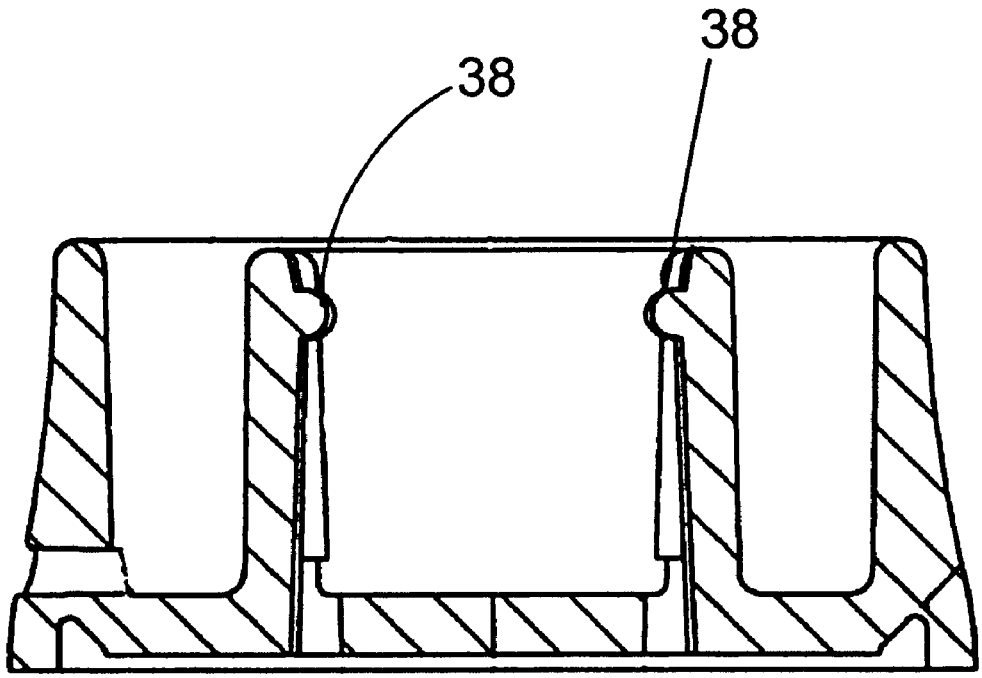
Figure 13:
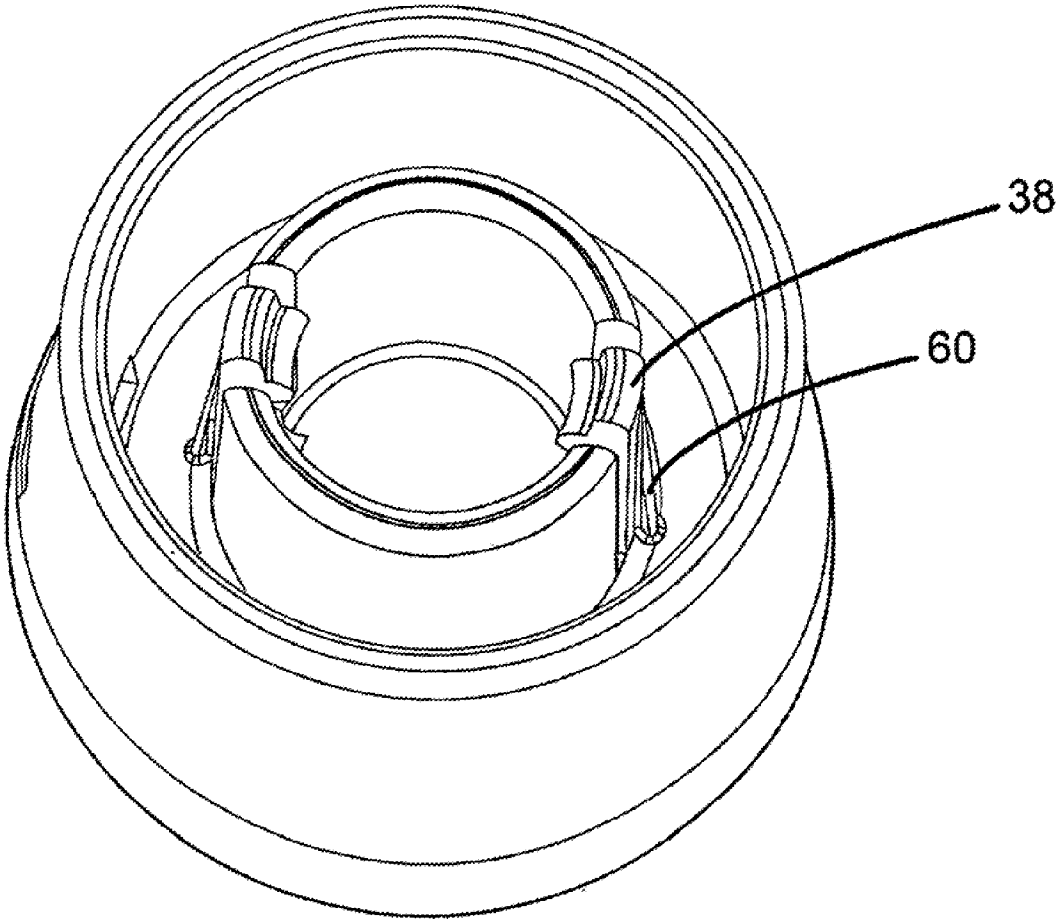

In yet another embodiment of the present invention, as illustrated in FIGS. 6 and 7, mount 16 may utilize at least one snap lock 38, rather than ball-detent 24, to engage first channel 20 such that container 12 is secured to mount 16 and yet is at least partially freely rotatable. In yet another embodiment, as illustrated in FIG. 13, the at least one snap lock 38 may include a rib 60 to make the snap lock arm more resilient. In the embodiment shown in FIGS. 6 and 7, container 12 may be secured to mount 16 by inserting container 12 into mount 16 such that snap locks 38 engage first channel 20. Container 12 may be removed from mount 16 by applying sufficient lifting force to disengage snap locks 38 from first channel 20.

Although various dispensing systems 10 have been described in considerable detail with reference to specific embodiments, the present invention is not confined to these embodiments. The present invention extends to all variations and equivalents thereof within the scope of the foregoing description, the accompanying drawings, and the following claims.

The invention claimed is:

1. A dispensing container for use with a mount having a receiver, the container comprising: a projection including a first channel formed into at least part of the projection and a second channel arranged substantially perpendicularly to the first channel and intersecting the first channel, wherein the first channel and second channel are adapted to slidably interact with a means for securing that is associated with the receiver; and wherein the projection is: (1) releasably secured to the receiver, such that the container is at least partially secured in the mount; and (2) permit the container, while secured in the mount, to move from a first orientation to a second orientation.

2. The dispensing container of claim 1, wherein the securing means comprises a structure selected from the group consisting of a pin, ball detent, lock, snap-lock, arm and flange.

3. The dispensing container of claim 1, further comprising a third channel formed into at least part of the projection arranged substantially perpendicularly to the first channel and intersecting the first channel, wherein: (a) the second channel is inclined such that: (i) the securing means associated with the receiver can slidably interact with the second channel to permit securing the container to the mount; and (ii) the securing means associated with the receiver cannot slidably interact with the second channel to permit removing the container from the mount; and (b) the third channel is inclined such that: (i) the securing means associated with the receiver can slidably interact with the third channel to permit removing the container from the mount; and (ii) the securing means associated with the receiver cannot slidably interact with the third channel to permit securing the container to the mount.

4. The dispensing container of claim 1, wherein the first channel extends at least partially around a circumference of the projection, and wherein the securing means associated with the receiver is at least one snap lock extending from the receiver.

5. A container for use with a mount, the container comprising (1) a dispenser for dispensing material within the container, and (2) a projection adapted to interface with the mount, the projection comprising a first locking mechanism, oriented generally parallel to an axis passing through a center of the projection, and a second locking mechanism, oriented at least skew to the axis, wherein each of the first and second locking mechanisms are adapted to interface with the mount to impede removal of the container while allowing the container to move from a first orientation to a second orientation.

6. The container of claim 5, wherein the projection extends from a bottom portion of the container and the first locking mechanism comprises no more than one channel at least partially circumscribing the projection wherein the channel is adapted to interact with securing means on a mount such that: (i) the container can be releasably secured to the mount; and (ii) the container can be at least partially rotated from the first orientation to the second orientation while the container remains releasably secured in the mount and without disengaging from the mount.

7. The container of claim 6, wherein the projection has an upper portion that meets a bottom of the container and the channel is located proximate to an upper portion of the projection.

8. The container of claim 5, wherein the projection extends from a portion of the container, wherein the first locking mechanism comprises a first channel at least partially surrounding the projection, wherein the second locking mechanism comprises a second channel that: (1) intersects the first channel; and (2) extends to an edge of the projection, wherein the first channel and the second channel are adapted to couple with portions of the mount.

9. The container of claim 8, wherein the portion that the projection extends from is the bottom of the container; the edge is located at the bottom of the projection; and the second channel runs generally from the edge towards the bottom of the container.

10. The container of claim 8, wherein the second channel comprises an incline that accepts a securing means associated with the mount as the container is inserted in the mount; and the incline includes a top portion that bears against the securing means to preclude removal of the container from the mount.

11. The container of claim 8, wherein the projection comprises a third channel that, when aligned with the securing means, allows the securing means to slide along the channel so as to facilitate removal of the container from the mount.

* * * * *